US005890339A

United States Patent [19]

Willis

[11] Patent Number: 5,890,339

[45] Date of Patent: Apr. 6, 1999

[54] HINGED PITCH BREAK CONNECTOR

[75] Inventor: David R. Willis, Arlington, Tex.

[73] Assignee: Alpine Engineered Products, Inc., Pompano Beach, Fla.

[21] Appl. No.: 711,483

[22] Filed: Sep. 10, 1996

[51] Int. Cl.[6] ..... E04B 1/38; E04C 3/11; F16C 11/00

[52] U.S. Cl. ..... 52/640; 52/645; 52/90.1; 52/656.9; 52/713; 16/319; 16/390

[58] Field of Search ..... 52/71, 90.1, 639, 52/640, 645, 655.1, 656.9, 704, 708, 713; 403/119, 150, 157; 16/319, 390

[56] References Cited

U.S. PATENT DOCUMENTS

| | | | |
|---|---|---|---|
| 3,535,845 | 10/1970 | Troutner . | |
| 3,785,108 | 1/1974 | Satchell | 52/645 |
| 4,335,555 | 6/1982 | Southerland et al. | 52/639 |
| 4,381,635 | 5/1983 | Solo | 52/639 |
| 4,449,335 | 5/1984 | Fahey | 52/713 X |
| 4,485,544 | 12/1984 | Van Ryswyk | 29/417 |
| 4,982,545 | 1/1991 | Stromback | 52/639 |
| 5,010,709 | 4/1991 | Paz | 52/658 |
| 5,426,822 | 6/1995 | Weir | 52/645 X |

FOREIGN PATENT DOCUMENTS

| | | | |
|---|---|---|---|
| 149145 | 6/1950 | Australia | 16/390 |
| 489417 | 2/1919 | France | 16/390 |

OTHER PUBLICATIONS

"Alpine Unimast Steel Truss System," *Automated Builder*, Apr., 1996.

"New Light Gauge Steel Truss Framing System Developed by Alpine," *Automated Builder*, Apr., 1996.

"Framing Systems Update," *Roofer*, Jun., 1996.

*Primary Examiner*—Robert J. Canfield
*Attorney, Agent, or Firm*—Crutsinger & Booth

[57] ABSTRACT

A pitch break connector is provided. The pitch break connector has an outside and inside rigid member. Each member has a first generally U-shaped channel defined by a spine member between first and second legs. Each member has a first and a second pivot end portion. A hinge pivotally connects the inside and outside members through the pivot end portions in a generally longitudinally opposing position. In this configuration, the first and second end portions of the inside member can be pivotally accepted into a cavity defined by the generally U-shaped channel of the outside member when the members are pivoted about the hinge.

16 Claims, 4 Drawing Sheets

HINGED PITCH BREAK CONNECTOR

TECHNICAL FIELD

This invention relates to a pitch break connector with a hinge for connecting chords used in truss systems at a desired pitch.

BACKGROUND OF THE INVENTION

Steel truss systems are sought out as an alternative to conventional wooden truss systems because steel trusses have several desirable characteristics. For example, steel framing is not flammable. Steel framing allows increased roof spans typically from about 30 to 40 foot spans, and in some truss designs up to 70 feet Additionally, components made of steel are reusable and recyclable. Also, steel products are less expensive than lumber products in view of increasing lumber prices.

Framing systems come into two basic categories. The first category is heavy hot-rolled steel systems sections, typically used in the construction of pre-engineered metal buildings. The second category is light-gauge steel framing systems. Light-gauge components are designed for use in truss systems and cooperate with other common-construction systems such as brick, mortar and/or wood. Light-gauge systems are realizing increased interest over hot-rolled steel systems because in a large number of re-roof and new construction jobs post and beam style systems using hot-rolled steel do not make economic sense in comparison to the lower cost alternative provided by light-gauge steel.

But light-gauge steel chords typically have square cut ends that are not pre-coped to fit with each other at angles other than 180-degrees. Otherwise, a construction-framer must cope the ends with hand tools or with power tools to achieve the desired pitch angle. Regardless of the method used, labor costs are involved to cope the ends and at times are not precise, requiring additional refining cuts. Therefore, consumers and builders demand greater design flexibility with light-gauge components. Thus there exists a need for a pitch break connector that allows for greater structure variability.

SUMMARY OF THE INVENTION

A pitch break connector is provided. The pitch break connector has an outside and inside rigid member. Each member has a first generally U-shaped channel defined by a spine member between first and second legs. Each member has a first and a second pivot end portion. A hinge pivotally connects the inside and outside members through the pivot end portions in a generally longitudinally opposing position. In this configuration, the first and second end portions of the inside member can be pivotally accepted into a cavity defined by the generally U-shaped channel of the outside member when the members are pivoted about the hinge.

In another aspect of the invention, each of the end portions are ears that extend longitudinally from the inside and outside members. The hinge is comprised of rivets that are offset from a longitudinal axis of said inside and said outside members and extend through each of the pivot end portions.

In yet another aspect of the invention, the hinge is a tab that extends from the spine member of the inside member to the spine member of the outside member above the first and second pivotal end portions.

These and other features and advantages of the present invention will be apparent to those skilled in the art upon reading the following detailed description of preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

DETAILED DESCRIPTION OF PREFERRED EMBODIMENT

Figure 1:
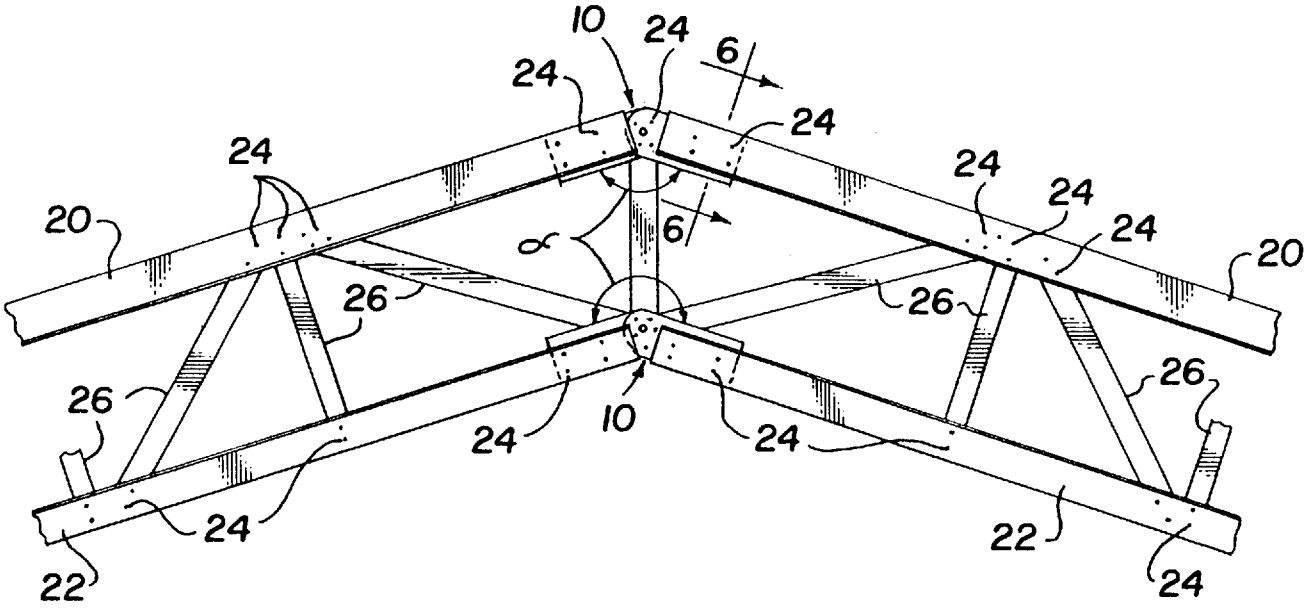
FIG. 1 is an elevation view of chord members mounted on a pitch break connector of the invention.

A pitch break connector generally designated by the numeral 10 is shown in FIG. 1. Chord members 20 and 22 are secured to connector 10 with sheet metal screws 24, rivets or the like. Brace members 26 are secured between chords 20 and 22, accordingly, forming a truss assembly. Connectors 10 are adjustable to provide a pitch angle $\alpha$ and then locked or secured in place by a plurality of sheet metal screws 24, rivets or the like. Preferably, connectors 10, and chord members 20 and 22, are secured in place by sheet metal screws with a dual-thread structure.

Figure 2:
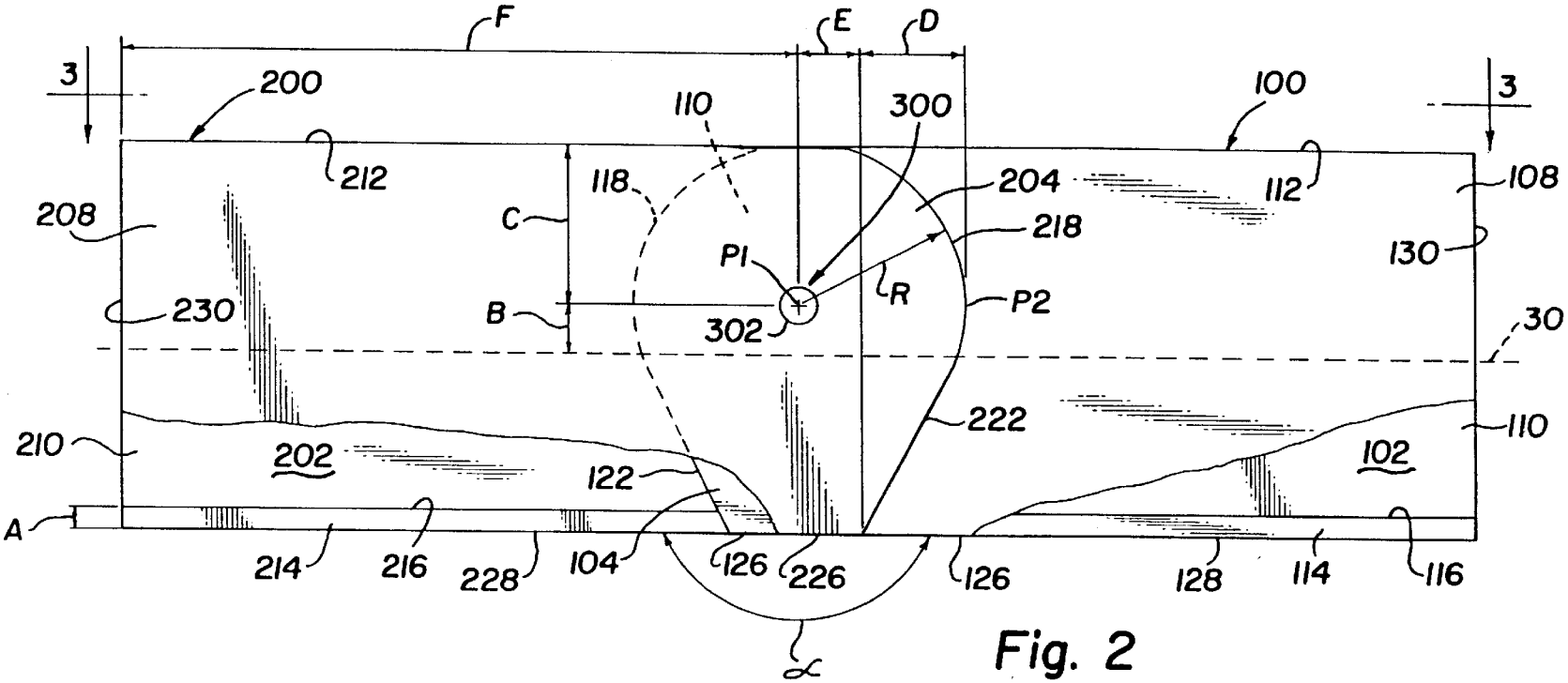
FIG. 2 is an elevation view of a first embodiment of the invention with portions broken out.

Referring to FIG. 2, a detailed illustration of pitch break connector 10 is shown. Connector 10 has an inside rigid member 100 and an outside rigid member 200 with generally U-shaped channels 102 and 202, respectively. A substantially central longitudinal axis 30 extends along the length of members 100 and 200, respectively. Connector 10 is made of a durable structural material sufficient to support standard building loads. Such a material is 20-gauge cold-rolled steel.

First and second pivot end portions 104 and 106 (shown in FIG. 3), accordingly, extend longitudinally from the inside member 100. Third and fourth pivot end portions 204 and 206 (shown in FIG. 3), accordingly, extend longitudinally from the outside member 200.

Figure 3:
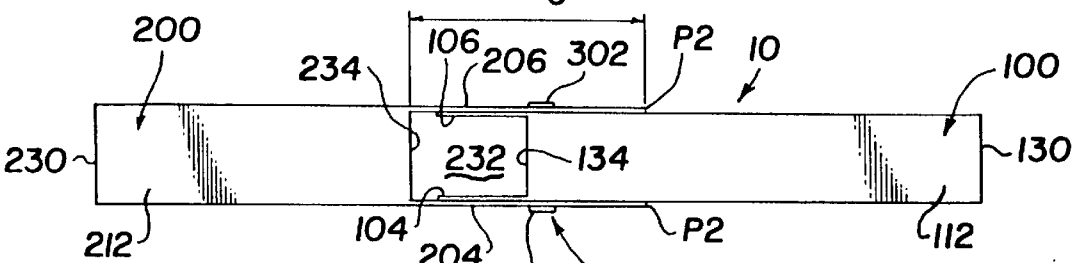
FIG. 3 is a top plan view of a first embodiment of the invention taken along line 3—3 in FIG. 2.

Referring to FIG. 3, hinge 300 pivotally connects first and third pivotal ends 104 and 204, respectively, such that they are opposed. When pivoted about hinge 300, first end 104 and second end 106 of the inside member 100 are slidingly accepted into the generally U-shaped channel 202 of the outside member 200.

For clarity, outside member 200 of pitch break connector 10 is described in further detail with the understanding that inside member 100 is substantially similar in proportion and structure. Similar structures and proportions of inside member 100 have similar nomenclature designations as those of outside member 200, but are designated in the "100" nomenclature series. For example, the cavity of outside member 200 is designated as 202, and the cavity of inside member 100 is designated as 102. Furthermore, it should be noted that minor variations in proportions can be effected without deviating from the scope and spirit of the invention.

Referring to FIG. 2, member 200 defines a U-shaped channel 202 with first planar member 208, second planar member 210 and spine member 212. First and second planar members 208 and 210 laterally extend from spine member 212.

Hem 214 extends along the bottom of planar members 208 and 210 and pivot ends 204 and 206 and has an upper edge 216. Width A of hem 214 is about 0.25 inches (about 63.5 millimeters). Hem 214 is a folded-over portion of first planar member 208 and second planar member 210 and pivot ends 204 and 206, respectively. Hem 214 aids to stiffen connector 10 and also covers jagged edges which may be formed on upper edge 216 by the process.

Third and fourth pivot end portions 204 and 206 have terminal edges which are each defined by circular edge portions 218 and substantially linear edge portions 222, respectively. Circular edge portion 218 has a center P1 at hinge 300, and a radial distance R. Radial distance R is about 1.5 inches (about 3.81 centimeters). On both end portions 204 and 206, circular edge portion 218 extends to a sloped substantially linear edge 222. Sloped linear edges 222 terminate at hemmed edges 226 and 228 of end potions 204 and 206, respectively.

Still referring to FIG. 2, sloped edge 222 originates at point P2, which is offset from longitudinal axis 30 and generally longitudinally aligned with point P1. Edge 222 slopes a distance D, which has a value from about 0.88 inches (about 2.23 centimeters) to about 0.90 inches (about 2.29 centimeters). Preferably, distance D is about 0.89 inches (about 2.27 centimeters). Thus, the slope of edge 222 is about 2.45, where distance D serves as the longitudinal reference in calculating the slope value.

Distance E is measured from the intersection of sloped edge 222 and hemmed edge 226 to a point substantially perpendicular (with respect to hemmed edge 226) to origin point P1. Distance E is about 0.606 inches (about 154 millimeters).

Figure 6:
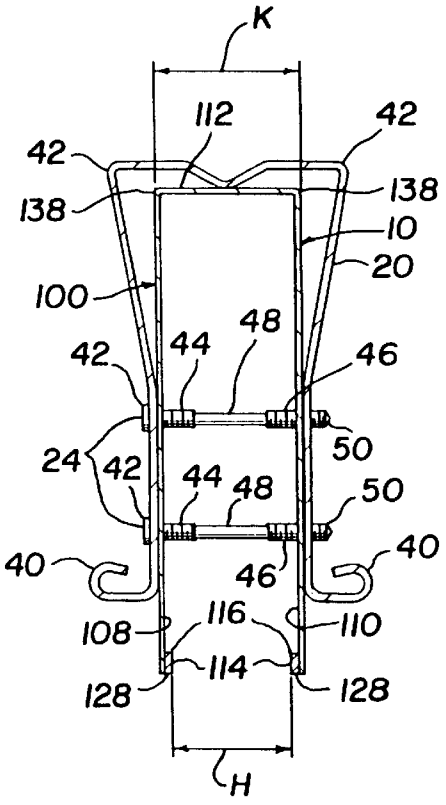
FIG. 6 is a cross-sectional view of the invention taken along line 6—6 in FIG. 1.

Distance F is the distance from point P1 to edge 230, and has a length sufficient to provide screw contact area between chord members 20 and 22 and connector 10. The screw area, for example, is the region in which chord 20 and member 200 overlap, as best illustrated in FIG. 6. A suitable length F of inside and outside members 100 and 200, respectively, is about 6 inches (about 15.24 centimeters).

Referring still to FIG. 2, hinge 300 and center point P1, accordingly, are offset from longitudinal axis 30 by distance B, which is from about 0.3 inches (about 76.2 millimeters) to about 0.4 inches (about 101.6 millimeters). Preferably, distance B is about 0.34 inches (86.4 millimeters). Respectively, hinge 300 and center P1, accordingly, are offset from spine member 212 by distance C. Distance C is from about 1.45 inches (about 3.68 centimeters) to about 1.55 inches (about 3.94 centimeters). Preferably, distance C is about 1.5 inches (3.81 centimeters). Hinge 300 is a pivotally securing device secured through apertures extending through end portions 104, 106, 204 and 206, respectively. A suitable securing device is formed of rivets 302. The apertures are generally centered about center point P1 and are of a size sufficient to receive rivets 302. Rivets 302 are of a length sufficient to clasp end portions 104 and 204 together and end portions 106 and 206, respectively.

Referring now to FIG. 3, a top view of pitch break connector 10 is shown illustrating a void or rectangular opening 232 in member 200. Opening 232 provides a larger variety of angular positions to which the connector 10 may be formed, as measured by angle $\alpha$. It should be noted that, because the appearance of opening 232 changes when angle $\alpha$ varies, the following description of rectangular opening 232 refers to connector 10 when angle $\alpha$ is substantially at 180-degrees, as best illustrated in FIG. 2. Rectangular opening 232 is formed because outside member end portions 204 and 206 extend from planar portions 208 and 210 further than inside member end portions 104 and 106 extend from planar portions 108 and 110, accordingly. Rectangular opening 232 extends from inside member edge 134 to outside member edge 234. Outside member pivot ends 204 and 206 extend a distance G from point P2 to edge 234 (best shown in FIG. 2).

Figure 4:
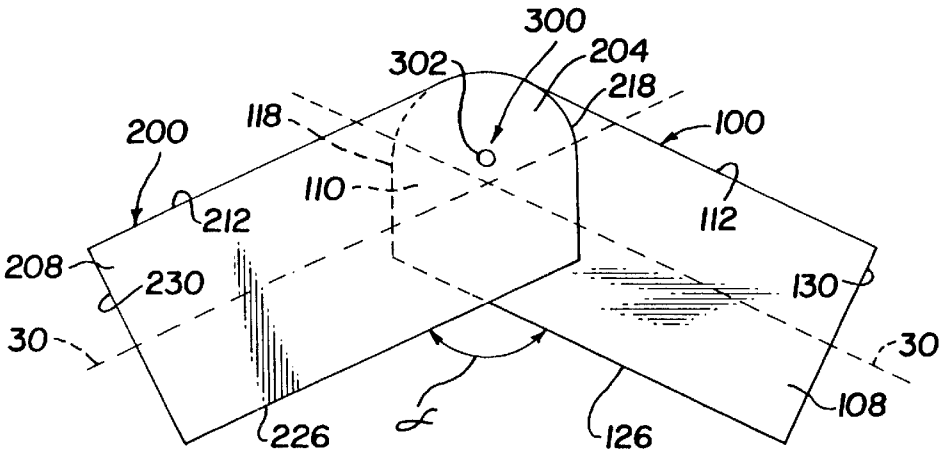
FIG. 4 is an elevation view of a first embodiment of the invention pivoted about its hinge in a first direction.
Figure 5:
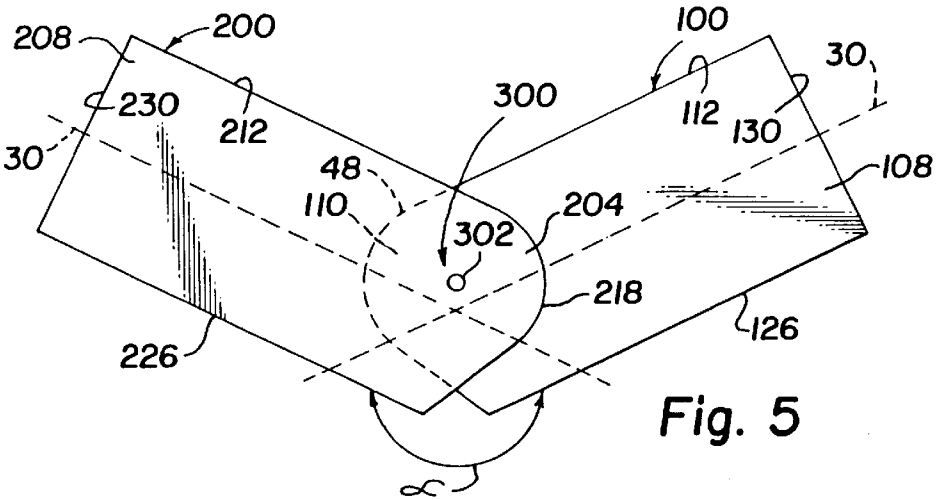
FIG. 5 is an elevation view of a first embodiment of the invention pivoted about its hinge in a second direction.

FIGS. 4 and 5 illustrate the ultimate angular positions available by connector 10. Referring to FIG. 4, connector 10 is positioned in a pitch break configuration typically encountered for forming ridges in building roofs. Angle $\alpha$, referenced between edges 126 and 226, respectively, is adjustable in a first direction from the position shown in FIG. 2 where angle $\alpha$ has a value of about 180 degrees. Connector 10 can be adjusted in a first direction to about 65 degrees to accommodate roof spans for building construction.

Referring to FIG. 5, connector 10 is adjustable in a second direction from the position shown in FIG. 2 to form a pitch break joint. Rectangular opening 232, discussed earlier, allows a further degree of freedom with respect to angle $\alpha$. The maximum magnitude of angle $\alpha$ between edges 126 and 226, respectively, is about 297-degrees.

Throughout the angular positions shown in FIGS. 4 and 5, the amount of sheet lapped area, remains at least a minimum value. One lapped area, for example, is defined as that area where pivot end portion 104 and 204 overlap. For example, with the dimensions provided above, the lapped area of connector 10 is about 7.5 inches$^2$ (about 19.05 cm$^2$). This lapped area remains relatively constant throughout the positions of connector 10 represented in FIGS. 4 and 5. Thus, the number of #12-size screws that can be used to secure members 100 and 200 in a fixed position is about twenty-five. Preferably, sheet metal screws having a dual-threaded structure are used, described later herein.

Referring to FIG. 6, a cross-section of chord 20 mounted to connector member 100 is shown. Chord member 20 is secured to connector 10 with sheet metal screws 24, rivets or the like. Preferably, sheet metal screws having a dual-thread structure are used such as those shown in FIG. 6. Sheet metal screw 24 has a hexagonal head 42 extending to a first threaded portion 44. First threaded portion 44 is connected to second threaded portion 46 through blank shank portion 48. Sheet metal tip 50 connects to second threaded portion 46. Screws 24 are installed by rotating screw 24 and urging sheet metal tip 50 against the assembly at connector 10 and chord 20 intersection or the connector's sheet screw contact area such that tip 50 taps a hole therethrough. With continuous urging and rotation, sheet metal screw 24 threads into the opposing sides of connector 10 and chord 20. Blank portion 48 deters expansion and subsequent deformation of the opposing sides of connector 10 and chord 20. That is, as second threaded portion 46 is threaded through chord 20 and first leg member 108, blank portion 48 slides through the hole until tip 50 encounters second leg member 110. Blank portion 48 extends through the hole made by second threaded portion 46. Although screw 24 is continuously rotated, first threaded portion 44 does not threadingly engage the hole until second threaded portion 46 taps into second leg member 100.

Again, for clarity, the following description of the cross-section of chord 20 and member 100 is provided with the understanding that similar connections of a chord member to connector member 200 is substantially similar and is thus not necessary to repeat here. Comer 138 between spine member 112 and first leg member 108 and corner 138 between spine member 112 and second leg member 110 each have radial curves of about 0.04 inches (about 10.16 millimeters). Member 100 is flared outward such that the general cross-sectional area of member 100 defined by planar members 108 and 110 and spine member 112 is generally trapezoidal. That is, length H and length K are substantially similar. But it should be noted that these lengths can vary from one another without departing from the scope and spirit of the invention. Length H is the distance between hem inner surfaces 140. Length K is the distance between the outer edge of corner 136 to the outer edge of corner 138. An advantage of this flared configuration is to allow brace members 26 to be inserted with ease.

Channel or chord 20 has roll-formed lip 40 which are elevated to a level similarly matching top corner edges 52. The alignment of these two points allows finished trusses to be stacked flat and banded together. Also, roll-formed lips 40 avoids dangerous sharp edges and limits damage to objects pulled through the finished trusses.

DESCRIPTION OF A SECOND EMBODIMENT

Figure 7:
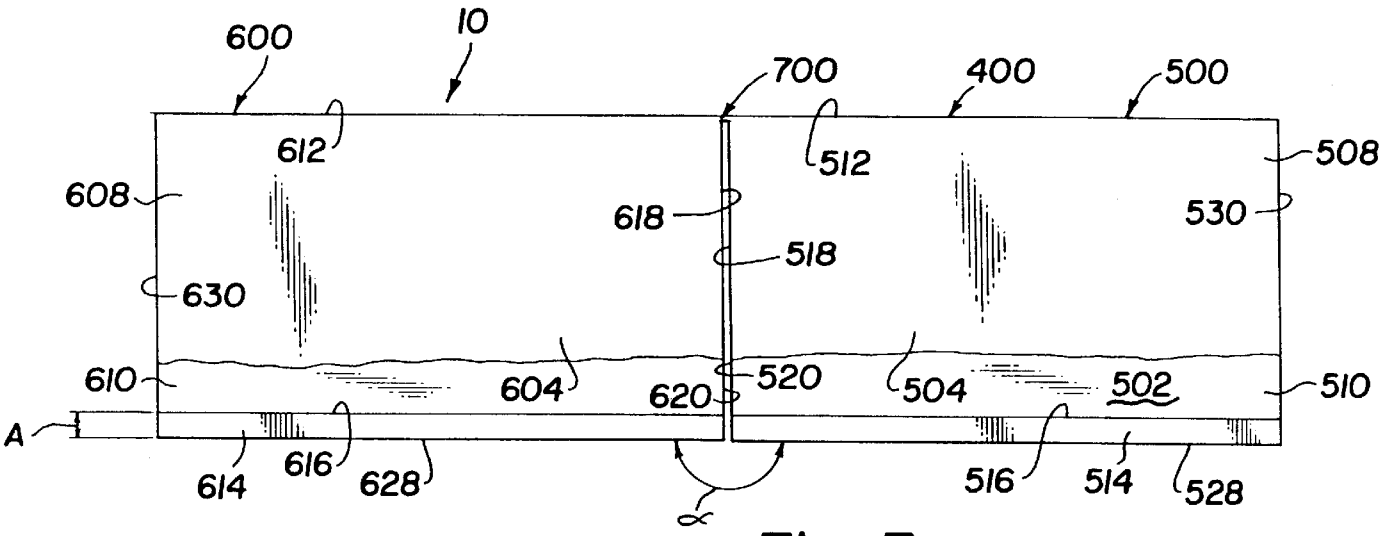
FIG. 7 is an elevation view of a second embodiment of the invention in a 180-degree position.

Referring to FIG. 7, a second embodiment of a pitch break connector 10, generally designated by the numeral 400, is shown. Connector 400 has an inside rigid member 500 and an outside rigid member 600 with generally U-shaped channels 502 and 602, respectively. Connector 400 is made of a durable structural material capable of at least withstanding common building loads. Such a material is 20-gauge steel plate.

First and second pivot end portions 504 and 506, respectively, are defined by areas of legs 508 and 510 of the inside member 500. Third and fourth pivot end portions 604 and 606, respectively are likewise defined by areas of planar member 608 and 610 of the outside member 600. "Pivot end portion" as used in the description of this embodiment is defined as those regions of first and second members 500 and 600, respectively, that overlap when angle $\alpha$ is at about 90-degrees.

Hinge 700 pivotally connects inside and outside members through spine members 512 and 612, respectively, such that the first and third end portions 504 and 604, respectively and second and fourth end portions 506 and 606, respectively, are adjacent. When pivoted about hinge 700, first end 504 and second end 506 of the inside member 500 are slidingly accepted into the generally U-shaped channel 602 of the outside member 600.

For clarity, outside member 600 of pitch break connector 400 is described in further detail with the understanding that inside member 500 is substantially similar in proportion and structure. Similar structures and proportions of inside member 500 have similar nomenclature designations as those of outside member 600, but are contained in the "500" nomenclature series. For example, the cavity of outside member 600 is designated as 602, and the cavity of inside member 500 is designated as 502. Structural differences between the two members will be set out, but it should be noted that minor variations in proportions can be accomplished without deviating from the scope and spirit of the invention.

Member 600 defines U-shaped channel 602 with first planar leg member 608, second planar leg member 610 and spine member 612. First and second planar members 608 and 610 extend laterally from spine member 612.

Hems 614 extend along bottom edges 628 and 626 (in FIG. 8), and have upper edges 616. Width A of hem 614 is about 0.25 inches (about 63.5 millimeters). Hem 614 is a folded-over portion of first planar member 608 and second planar member 610, respectively. Hem 614 aids to stiffen connector 10 and also covers jagged edges which may be formed by the process.

Third and fourth pivot end portions 604 and 606 terminate in substantially linear edges 618 and 620, respectively.

Referring still to FIG. 7, hinge 700 is pivoted by urging outside member 600 and inside member 500 toward each other such that angle $\alpha$ decreases from about 180 degrees towards 90 degrees. Hinge 700 has a length between members 500 and 600 and a thickness sufficient to allow manual urging of said members towards each other. For example, when using 20-gauge steel plate, which has a standard thickness of about 0.0329 inches (about 8.35 millimeters) to manufacture pitch break connector 400, a sufficient length of hinge 700 is about 0.125 inches (about 31.75 millimeters) and a sufficient thickness of hinge 700 is about 0.09 inches (about 22.86 millimeters).

Figure 8:
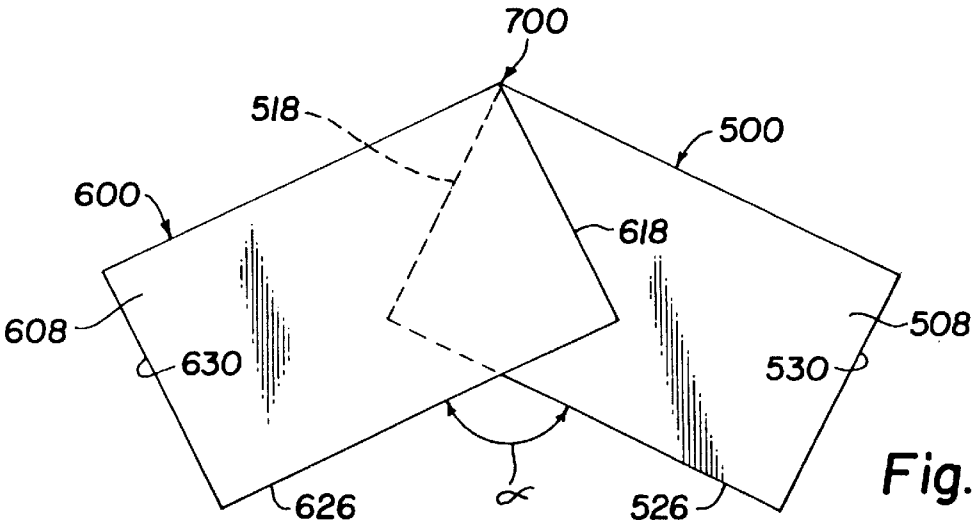
FIG. 8 is an elevation view of a second embodiment of the invention pivoted about its hinge in a first direction.

FIG. 8 illustrates the angular positioning of connector 400 for forming ridges building roofs. Angle $\alpha$, referenced between edges 526 and 626, respectively, is adjustable in a first direction from the position shown in FIG. 7 where angle $\alpha$ has a value of about 180 degrees. Connector 10 can be adjusted for providing ridges from about 166 degrees to about 90 degrees.

The angular positions of connector 400 are limited by the amount of lapped area, available for interconnecting members 500 and 600, respectively, to each other through end portions 504, 506, 604 and 606, respectively. The lapped area between planar members 508 and 608, for example, is defined by that area bordered by edges 518, 526, 618 and 626. As above, sheet metal screws with a dual thread structure are preferred. The following table shows, for example, with the dimensions provided above, the contact area of connector 400 available for #12-size screws when angle $\alpha$ is varied:

| Angle | Contact Area ($in^2$) | Number of Screws |
|---|---|---|
| 166 | .095915 | 2 |
| 151 | 1.186985 | 6 |
| 126 | 3.631174 | 14 |
| 112 | 5.842014 | 20 |
| 90 | 12.465965 | 32 |

Chord 20, shown in FIG. 1, can also be attached to connector 10 embodied with hinge 700 and members 500 and 600.

The description and figures of the specific examples above do not point out what an infringement of this invention would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined in the following claims.

Having described the invention, what is claimed is:

1. A pitch break connector comprising:

an inside rigid member having a longitudinally extending spine member between a first and a second leg defining a first generally U-shaped channel, said inside member having a first and a second pivot end portion;

an outside rigid member having a longitudinally extending spine member between a first and a second leg defining a second generally U-shaped channel, said outside member having a third and a fourth pivot end portion; and a hinge pivotally connecting said inside and said outside members through said pivot end portions in a generally longitudinally opposing position such that said first and second end portions of said inside member can be pivotally accepted into said generally U-shaped channel of said outside member when said members are pivoted about said hinge.

2. A pitch break connector as defined in claim 1 wherein each of said end portions are ears extending longitudinally from said inside and said outside members.

3. A pitch break connector as defined in claim 2 wherein said hinge is a rivet offset from a longitudinal axis of said inside and said outside members and extending through each of said pivot end portions.

4. A pitch break connector as defined in claim 3 wherein each of said pivot end portions have a terminal edge having a circular portion and a linear portion, said circular portion being centered about said hinge, said circular portion extending to said linear portion.

5. A pitch break connector as defined in claim 4 wherein said inside and said outside members can be pivoted from an angle of about 297 degrees to about 65 degrees.

6. A pitch break connector as defined in claim 4 wherein said first and second end portions extend further distance from said legs of said inside member than said third and fourth end portions extend from said legs of said outside member thereby defining a generally rectangular opening in said spine of said outside member.

7. A pitch break connector as defined in claim 6 wherein said inside and said outside members can be pivoted in a first direction from an angle of about 180 degrees to about 65 degrees and in a second direction from an angle of about 180 degrees to about 297 degrees.

8. A pitch break connector as defined in claim 6 further comprising:

a hemmed edge on a longitudinal edge of each leg of said outside member and a hemmed edge on each leg of said inside member.

9. A pitch break connector as defined in claim 8 wherein said hemmed edge is a folded-over longitudinal portion of said outside legs and said inside legs.

10. A pitch break connector as defined in claim 1 wherein said hinge is at least one rivet extending through at least one said pivot end portion of said inside member and at least one said pivot end portion of said outside member.

11. A truss for use in building construction, the truss comprising:

a pitch break connector having an inside rigid member having a longitudinally extending spine member between first and second legs defining a first generally U-shaped channel, said inside member having first and a second pivot end portions, an outside rigid member having a longitudinally extending spine member between first and second legs defining a second generally U-shaped channel, said outside member having third and fourth pivot end portions, and a hinge pivotally connecting said inside and outside members through said pivot end portions in a generally longitudinally opposing position such that said first end portion and said second end portion of said inside member may be pivotally accepted into said generally U-shaped channel of said outer member when said members are pivoted about said hinge;

a first chord connected to said inside member having a generally U-shaped cross-section sufficient to accept said inside member with said cross-section; and a second chord connected to said outside member having a generally U-shaped cross-section sufficient to accept said outside member within said cross-section.

12. A truss as in claim 11 wherein each of said end portions are ears extending longitudinally from said inside and said outside members.

13. A truss as in claim 12 wherein said hinge is a rivet offset from a longitudinal axis of said inside and said outside members and extending through each of said pivot end portions.

14. A truss as in claim 13 wherein each of said pivot end portions have a terminal edge having a circular portion and a liner portion, said circular portion being centered about said hinge, said circular portion extending to said linear portion.

15. A truss as in claim 14 wherein said inside and said outside members can be pivoted from an angle of about 65 degrees to about 297 degrees.

16. A truss as in claim 14 wherein said outside member end portions extend further than said inside member end portions thereby defining a generally reticular opening on a top surface of said outside member.

* * * * *

UNITED STATES PATENT AND TRADEMARK OFFICE
CERTIFICATE OF CORRECTION

PATENT NO. : 5,890,339

DATED : April 6, 1999

INVENTOR(S) : David R. Willis

It is certified that error appears in the above-identified patent and that said Letters Patent is hereby corrected as shown below:

Column 3, line 51, "area" should be --areas--;

Column 7, line 41, after "extend" insert --a--;

Column 8, line 14, before "second" delete "a";

Column 8, line 24, change "outer" to read --outside--;

Column 8, line 53, change "reticular" to --rectangular--.

Signed and Sealed this

Fifteenth Day of February, 2000

*Attest:*

Q. TODD DICKINSON

*Attesting Officer*

*Commissioner of Patents and Trademarks*